US007374529B2

(12) United States Patent
Hensley et al.

(10) Patent No.: US 7,374,529 B2
(45) Date of Patent: May 20, 2008

(54) LINER FOR A CENTRIFUGE DISCHARGE PORT

(75) Inventors: Gary L. Hensley, Kingwood, TX (US); Lee Hilpert, Galveston, TX (US)

(73) Assignee: Hutchison Hayes, LP, Houston, TX (US)

( * ) Notice: Subject to any disclaimer, the term of this patent is extended or adjusted under 35 U.S.C. 154(b) by 47 days.

(21) Appl. No.: 11/380,256

(22) Filed: Apr. 26, 2006

(65) Prior Publication Data

US 2007/0254795 A1 Nov. 1, 2007

(51) Int. Cl.
*B04B 1/20* (2006.01)

(52) U.S. Cl. ..... 494/53

(58) Field of Classification Search ..... 494/53–54, 494/56–57; 210/380.1, 380.3
See application file for complete search history.

(56) References Cited

U.S. PATENT DOCUMENTS

| | | | | |
|---|---|---|---|---|
| 3,880,346 | A * | 4/1975 | Hopfe | 494/53 |
| 5,244,584 | A * | 9/1993 | Schlieperskoetter | 494/53 |
| 5,584,791 | A * | 12/1996 | Grimwood et al. | 494/54 |
| 5,800,332 | A | 9/1998 | Hensley | |
| 6,030,332 | A | 2/2000 | Hensley | |
| 6,102,843 | A | 8/2000 | Kelley et al. | |
| 6,149,572 | A | 11/2000 | Knelson | |
| 6,193,076 | B1 | 2/2001 | Hensley | |
| 6,290,636 | B1 * | 9/2001 | Hiller et al. | 494/53 |
| 6,432,299 | B1 | 8/2002 | Hensley et al. | |
| 6,932,913 | B2 | 8/2005 | Kirker et al. | |
| 6,966,874 | B2 | 11/2005 | Cornay et al. | |
| 6,971,525 | B2 | 12/2005 | Kirker et al. | |
| 7,001,324 | B2 | 2/2006 | Hensley et al. | |
| 7,282,019 | B2 * | 10/2007 | Lantz | 494/54 |
| 2005/0164861 | A1 * | 7/2005 | Bruning et al. | 494/56 |
| 2007/0254795 | A1 * | 11/2007 | Hensley et al. | 494/53 |

FOREIGN PATENT DOCUMENTS

| | | | |
|---|---|---|---|
| DE | 3620912 | A1 * | 12/1987 |
| DE | 3904151 | A1 * | 8/1990 |
| WO | 2006/081903 | A1 * | 8/2006 |

* cited by examiner

*Primary Examiner*—Charles E Cooley

(57) ABSTRACT

A conical housing of a horizontal decanter centrifuge includes a discharge port liner that attaches to the conical housing from the outside of the housing. The discharge port is substantially rectangular in configuration, and the liner slides down into the port opening. The liner is coupled to the housing with bolts or similar releasable coupling apparatus.

7 Claims, 3 Drawing Sheets

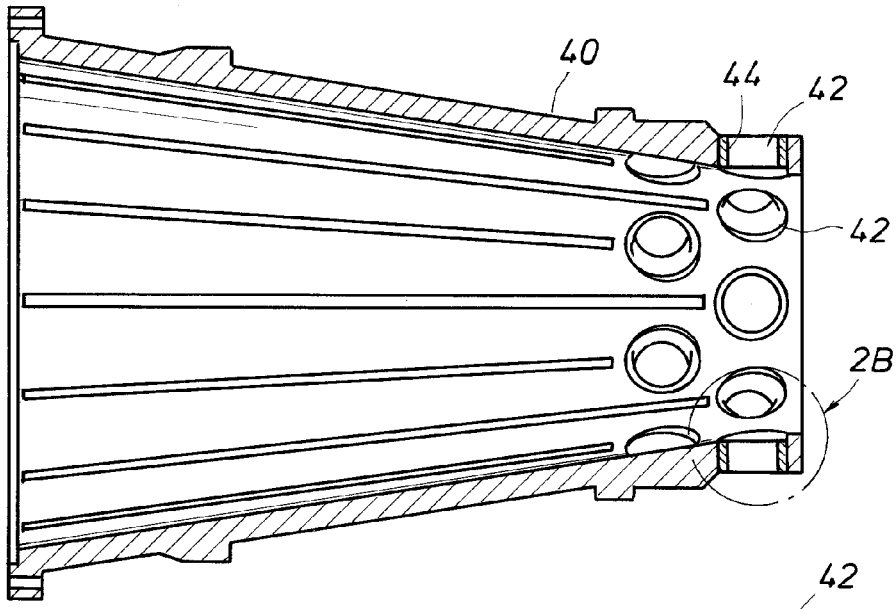
FIG. 2A (PRIOR ART)
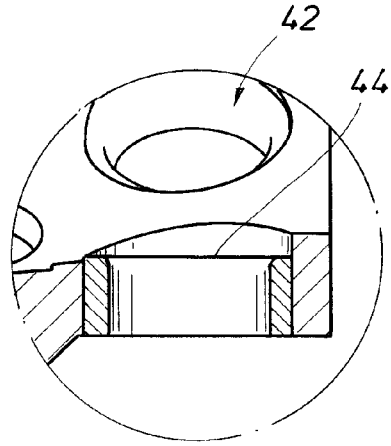
FIG. 2B
(PRIOR ART)
FIG. 3A
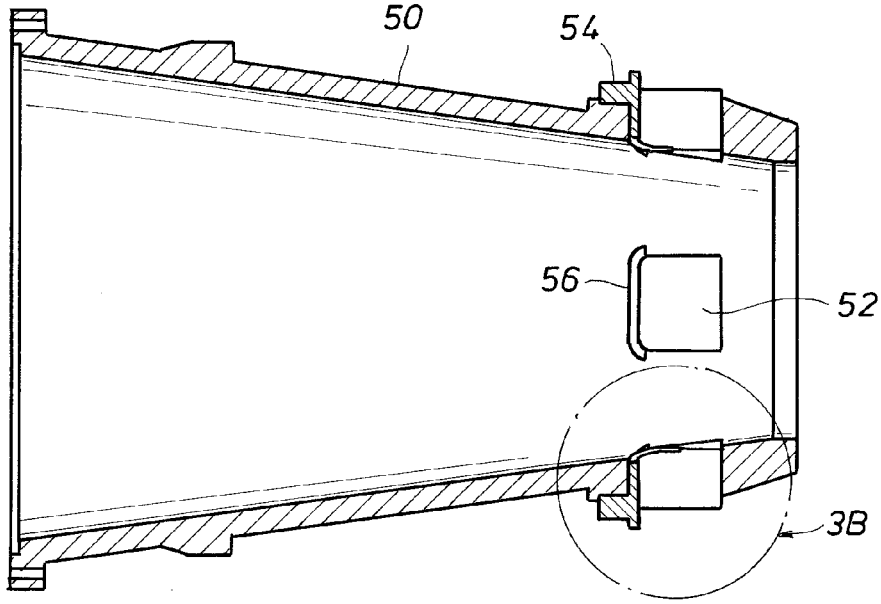

FIG.3B
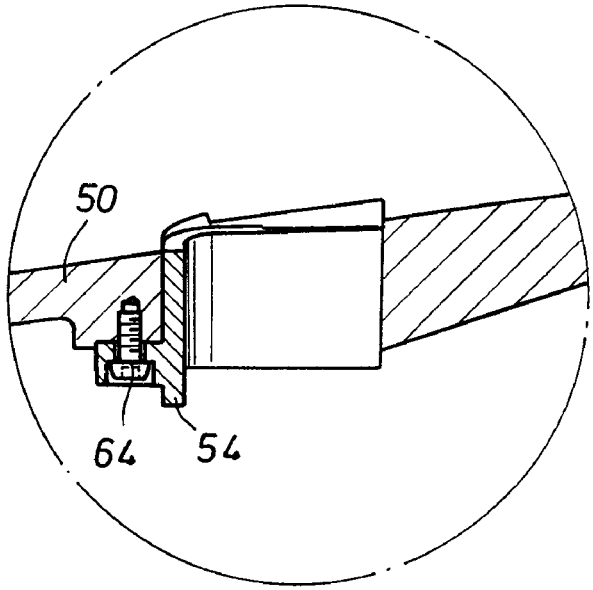
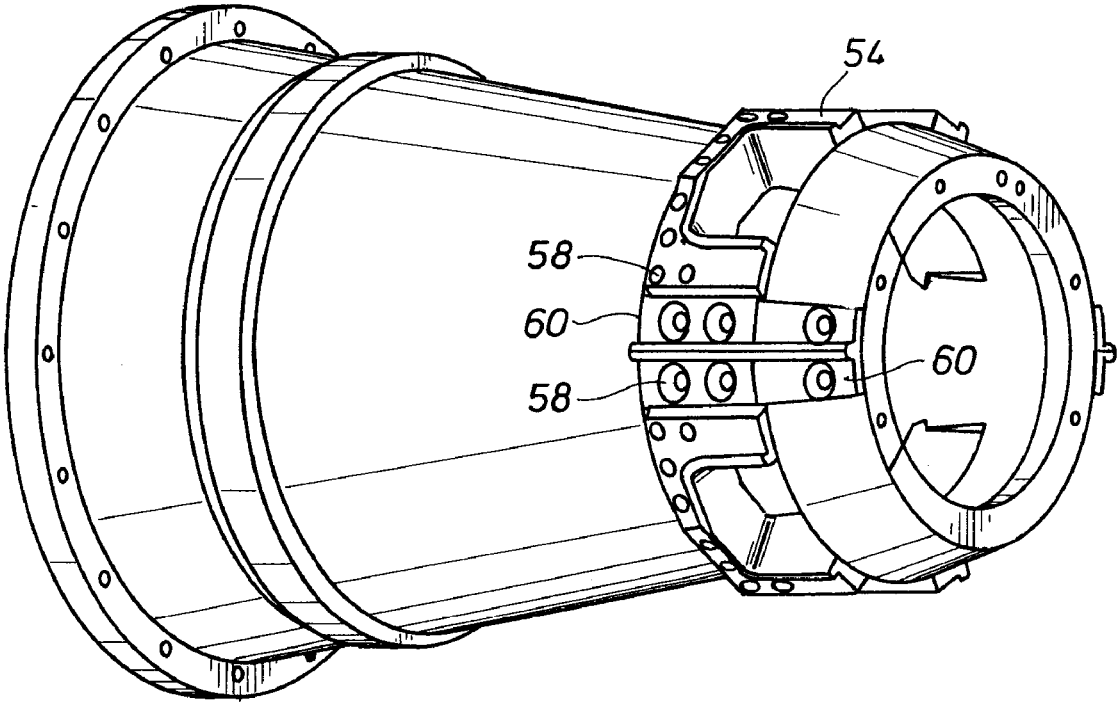
FIG.4

LINER FOR A CENTRIFUGE DISCHARGE PORT

FIELD OF THE INVENTION

The present invention relates generally to the field of decanter centrifuges and, more particularly, to a liner for the discharge port of such a centrifuge.

BACKGROUND OF THE DISCLOSURE

Horizontal decanter centrifuges are capable of processing large quantities of liquid and removing suspended solids from the liquid. These types of centrifuges are used in many different industries, but they find especially useful application in the oil and gas industry in the purification of drilling fluid, referred to as drilling mud.

In the purification of drilling fluid, huge quantities of sand and rock, including cuttings from the drilling process, are processed through one or more centrifugal separators. The mixture of solids and liquid enters a centrifuge and proceeds into a conical housing which turns at high speed, for example 3,000 rpm. At this speed, heavier solids migrate out to the inside surface of the conical housing, while the liquid migrates closer to the axis of rotation of the housing. A screw conveyor then scoops the solids which have accumulated on the inside surface of the housing toward a solids discharge port. The purified liquid, such as drilling mud, is discharged from the centrifuge at a liquids discharge port.

The sizes of the individual solid particles that are discharged from the solids discharge port fall within a wide range of diameters, but regardless of the sizes, these solid particles are abrasive as they pass over edges of the centrifuge discharge port. Over time, this abrasion requires maintenance on the centrifuge, which in the most severe cases may even call for the replacement of the conical housing.

In order to reduce the speed at which the abrasion of the discharge port occurs, known centrifuges include liners at the discharge ports. The discharge ports themselves are circular and the liners are inserted from the inside of the conical housing into the discharge port. The liners and the surface into which they are inserted are tapered, so that as the conical housing turns at high speed, the tapered liner presses more firmly into the circular opening of the discharge port.

Unfortunately, even the most wear resistant liner eventually erodes to the point that it no longer protects the discharge port. At this point, the liners in all of the discharge ports must be replaced. In most cases, this operation can only be performed by qualified personnel in a shop, and thus the centrifuge itself must be removed from its housing and shipped to a repair facility.

Once the centrifuge arrives at the repair facility, the conical housing must be removed in order for repair personnel to gain entry to the interior of the conical housing. Then, the eroded liners are removed and replaced with fresh ones. Finally, the refurbished conical housing is put back the centrifuge and the refurbished conical housing must then be balanced. If the conical housing is not properly balanced, then at 3,000 rpm the machine may generate unacceptable vibration or worse.

Thus, there remains a need for a device to protect the discharge ports of a horizontal, decanter centrifuge which will not require such an expensive and involved procedure as is current today in the art. The present invention is directed to filling this need in the art.

SUMMARY OF THE INVENTION

The present invention solves this drawback in the art by providing a discharge port liner that attaches to the conical housing of a horizontal decanter centrifuge from the outside of the housing. The discharge port is substantially rectangular in configuration, and the liner slides down into the port opening and is coupled to the housing with bolts or similar releasable coupling means.

By making the liners attachable from the exterior of the conical housing, the conical housing can remain in place in the centrifuge as the liners are replaced. Spacers fill the perimeter of the housing between the liners, and combined with the feature of not having to remove the housing during this maintenance operation eliminates the need for a balancing operation after installation of replacement liners.

These and other features and advantages of the present invention will be readily apparent to those of skill in the art from a review of the following description along with the accompanying drawings.

BRIEF DESCRIPTION OF THE DRAWINGS

FIG. 2A is a section view of a known conical housing.

FIG. 2B is a detail view of a discharge port of the housing of FIG. 2A.

FIG. 3A is a section view of a conical housing of the present invention including a plurality of liners coupled to the housing from the outside of the housing.

FIG. 3B is a detail view of a discharge port of the housing of FIG. 3A.

FIG. 4 is an isometric view of a conical housing of the present invention.

DETAILED DESCRIPTION OF A PREFERRED EMBODIMENT

Figure 1:
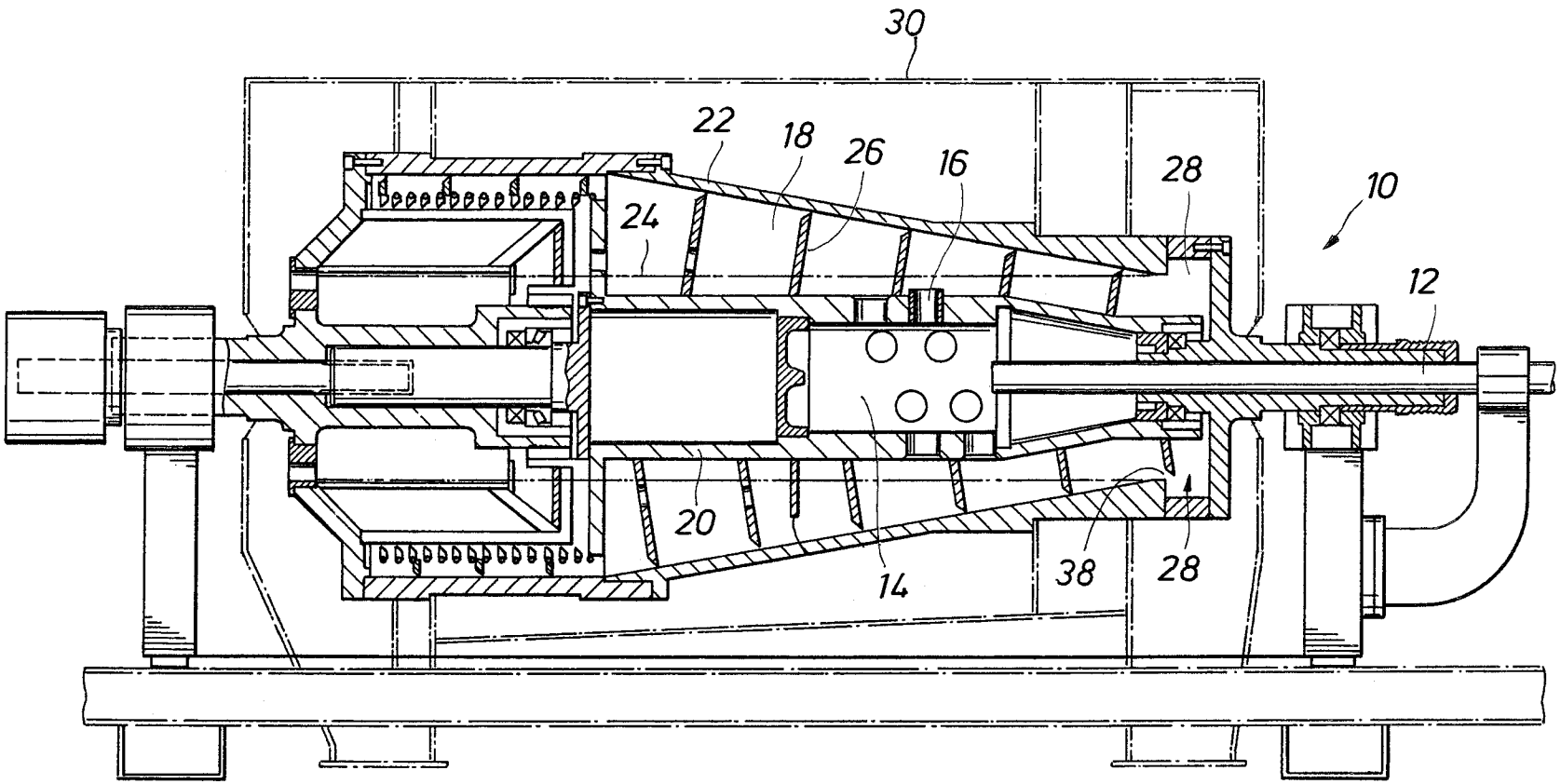
FIG. 1 is a side section view of a known centrifuge provided here to illustrate a solids discharge port of a horizontal decanter centrifuge.

Attention is directed to FIG. 1 where a known centrifuge 10 is illustrated in order to show the environment of the present invention. The centrifuge 10 includes an inlet tube 12 which receives a mixture of solids and liquid into an inlet chamber 14. The mixture flows from the inlet chamber through a plurality of nozzles 16 into a chamber 18 between a cylindrical shell 20 and a conical housing 22.

The cylindrical shell 20 and the conical housing both turn at high speed, but they turn at slightly different speeds. As they turn at high speed, heavier components of the mixture, such as cuttings, move to the inside surface of the conical housing 22, while the liquids are displaced toward the cylindrical shell, thereby defining a liquid level 24 referred to as the "pond". A screw conveyor 26 pushes the accumulated solids to the right, as seen in FIG. 1, and out a plurality of discharge ports 28. The entire assembly is enclosed within a protective covering 30, in a conventional manner. Much more detail of the structure and function of this example of a centrifuge are provided in U.S. Pat. No. 6,030,332, assigned to the same assignee as the present invention and incorporated herein by reference.

As the solids exit the discharge ports 28, they tend to abrade and erode a front edge 38 of the discharge port. Eventually, this erosion may require maintenance on the centrifuge, as previously described. In order to reduce the rate of wear at the discharge ports, liners have been used in the past to provide a harder, more wear resistant material at the points at which the abrasive solids discharge come in contact. This previous solution to this problem is illustrated in FIGS. 2A and 2B. FIG. 2A shows a conical housing 40, as previously described, and illustrates a plurality of discharge ports 42. To protect the edges of the discharge ports, liners 44 are inserted.

Note particularly the liner shown in FIG. 2B. The discharge port 42 is wider on the inside of the conical housing than at the outside surface. Thus, the liner tapers from the interior to the exterior of the housing. That means that the liner must be inserted into the discharge port from the inside, and thus the conical housing must be removed from the centrifuge in order to provide access for repairmen to replace the liners.

This problem is solved by the present invention as shown in FIGS. 3A, 3B, and 4. FIG. 3A illustrates a conical housing 50 including a plurality of discharge ports 52. In FIG. 2A, the known conical housing included circular discharge ports into two rows and offset from one another. However, the conical housing of this invention includes a single row of substantially rectangular discharge ports. Each of the discharge ports 52 is provided with a liner 54. We have made the discharge ports of our conical housing substantially rectangular because we have found that this structure provides more even wear of the liners 54 because the solids in the form of a slurry are flowing very nearly parallel with the axis of the conical housing, and thus the slurry passes over a front edge 56 of the liner very nearly perpendicular along the entire edge 56.

The liner 54 is inserted into the discharge port from the outside of the conical housing. The liner is coupled to the conical housing by a plurality of bolts 64, as shown in FIG. 3B, wherein the bolts 64 pass through the liner and then into the conical body. That way, in order to replace the liners, one need not remove the conical housing from the centrifuge. The liners are accessible to the repairman simply by opening the protective covering 30 (FIG. 1). Also, a set of spacers 60 are installed between each of the liners 54. The spacers maintain proper spacing and orientation of the liners, and eliminate the need for a balancing procedure on the conical housing after new liners are installed.

Note also that the leading edge 56 extends into the interior of the conical housing. This feature provides great wear volume for the liner, while also developing a slight turbulence in the flow just at the edge as the solids slurry exit the conical housing, thus reducing the impact of the abrasive solids on the liner.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A conical housing for a horizontal decanter centrifuge, the housing comprising:

a. a conical body having a wide end, a narrow end, an inside surface, and an outside surface;

b. a plurality of discharge ports at the narrow end of the body; and c. a liner in each of the plurality of discharge ports inserted from the outside surface of the conical body, wherein the liner in each of the plurality of discharge ports is bolted to the conical body by a plurality of bolts through the liner and then into the conical body.

2. The housing of claim 1, wherein each of the plurality of discharge ports is substantially rectangular.

3. The housing of claim 1 wherein the liner in each of the plurality of discharge ports defines a substantially straight leading edge.

4. The housing of claim 3, wherein the substantially straight leading edge of each liner extends beyond the inside surface of the conical body.

5. The housing of claim 1, further comprising a spacer between each liner and the liner adjacent to it, wherein the spacer is mounted to the outside surface of the conical body.

6. A conical housing for a horizontal decanter centrifuge, the housing comprising:

a. a conical body having a wide end, a narrow end, an inside surface, and an outside surface;

b. a plurality of substantially rectangular discharge ports at the narrow end of the body; and c. a liner in each of the plurality of discharge ports inserted from the outside surface of the conical body, wherein the liner in each of the plurality of discharge ports is bolted to the outside surface of the conical body by a plurality of bolts passing through the liner and then into the conical body.

7. The housing of claim 6, further comprising a spacer between each liner and the liner adjacent to it, wherein the spacer is mounted to the outside surface of the conical body.

* * * * *